US005578777A

United States Patent [19]

Lombardi

[11] Patent Number: 5,578,777

[45] Date of Patent: Nov. 26, 1996

[54] DRUM BEATER AND PEDAL APPARATUS ALLOWING INFINITELY ADJUSTABLE BEATER POSITIONING

[76] Inventor: Donald G. Lombardi, 2118 E. Hillcrest Dr., Thousand Oaks, Calif. 91360

[21] Appl. No.: 354,212

[22] Filed: Dec. 12, 1994

Related U.S. Application Data

[63] Continuation-in-part of Ser. No. 190,499, Feb. 2, 1994, Pat. No. 5,396,826, which is a continuation-in-part of Ser. No. 35,065, Mar. 22, 1993, Pat. No. 5,361,670, which is a continuation of Ser. No. 783,864, Oct. 28, 1991, Pat. No. 5,204,485.

[51] Int. Cl.[6] ..... G10D 13/00

[52] U.S. Cl. ..... 84/422.1

[58] Field of Search ..... 84/422.1–422.4

[56] References Cited

U.S. PATENT DOCUMENTS

| | | | |
|---|---|---|---|
| 3,618,441 | 11/1971 | Fearns . | |
| 3,742,806 | 7/1973 | Zalmer . | |
| 3,968,718 | 7/1976 | Carver . | |
| 4,048,896 | 9/1977 | Calato et al. | 84/422.1 |
| 4,188,853 | 2/1980 | Bills . | |
| 4,538,499 | 9/1985 | Livingston . | |
| 4,691,613 | 9/1987 | Jacobson | 84/422.1 |
| 4,756,224 | 7/1988 | Lombardi . | |
| 4,890,532 | 1/1990 | Carlson | 84/422.1 |
| 4,945,803 | 8/1990 | Norwood | 84/422.1 |
| 5,204,485 | 4/1993 | Lombardi . | |
| 5,361,670 | 11/1994 | Lombardi | 84/422.1 |
| 5,365,824 | 11/1994 | Hoshino | 84/422.1 |
| 5,396,826 | 3/1995 | Lombardi | 84/422.1 |

FOREIGN PATENT DOCUMENTS

| | | |
|---|---|---|
| 62201792 | 12/1987 | Japan . |
| 644147 | 2/1989 | Japan . |

*Primary Examiner*—William M. Shoop, Jr.
*Assistant Examiner*—Jeffrey W. Donels
*Attorney, Agent, or Firm*—William W. Haefliger

[57] ABSTRACT

A drum beating assembly comprising a frame, including at least one pedestal; an axle carried by the pedestal to rotate relative thereto, the axle having an axis of rotation; a drum beater carried by the axle; a pedal operatively connected to the axle to rotate the axle and beater in response to pedal movement; a crank connected with the axle to rotate therewith; a return spring positioned to exert tension on the crank to yieldably resist axle rotation by the pedal, about the axis; and an infinitely adjustable connection between the spring and crank to allow adjustment of the position of spring tension exertion on the crank, about the axle axis, whereby the rest position of the beater relative to a drum surface may be infinitely adjusted.

26 Claims, 5 Drawing Sheets

3
22c
21c
22a
21a
22
21
22b
21b
16
16b
16c
56a
61
58a
58c
60
15
19
18
14
54
42
59
58b
19c
49
12a
22d
21d
16a
56
46
17
11
12
35
41
31
13
10
3

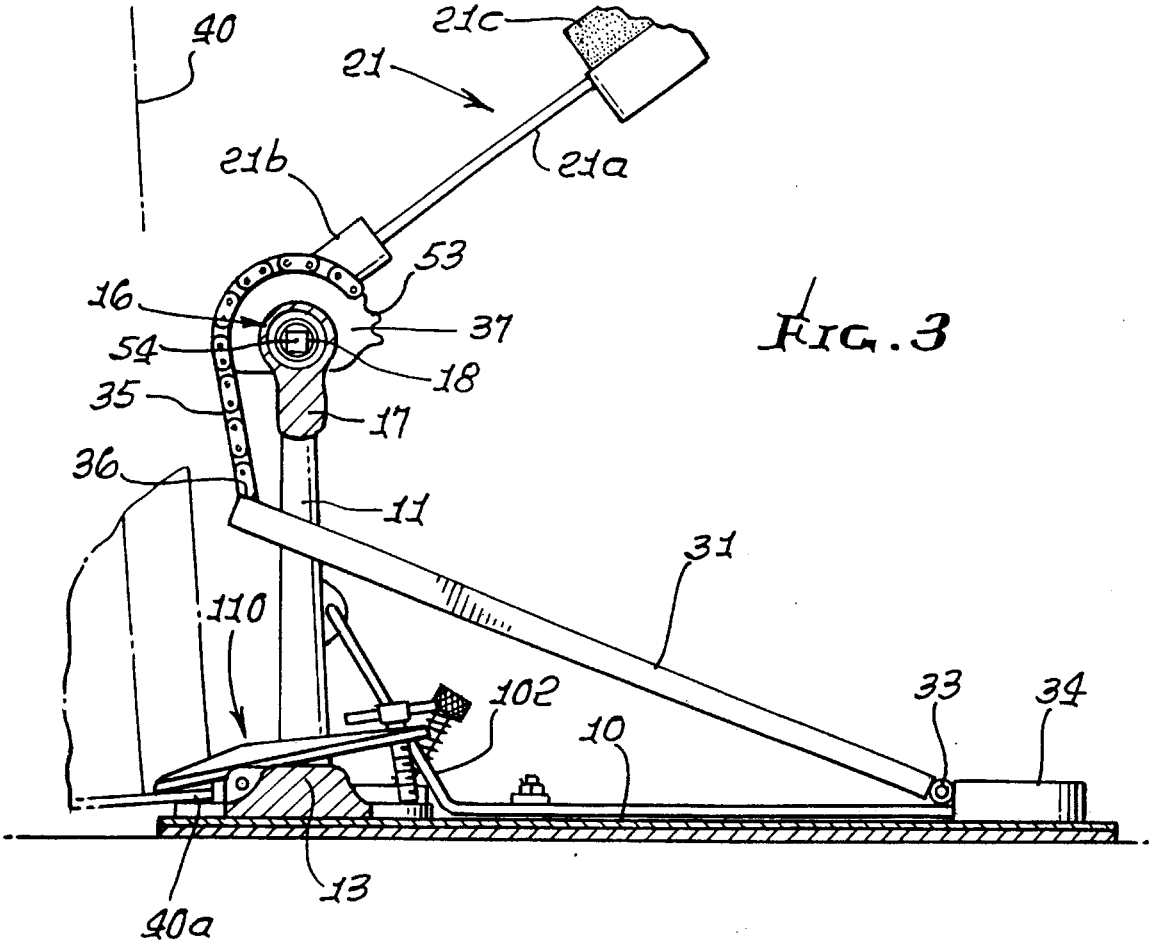
FIG. 3
FIG. 5.
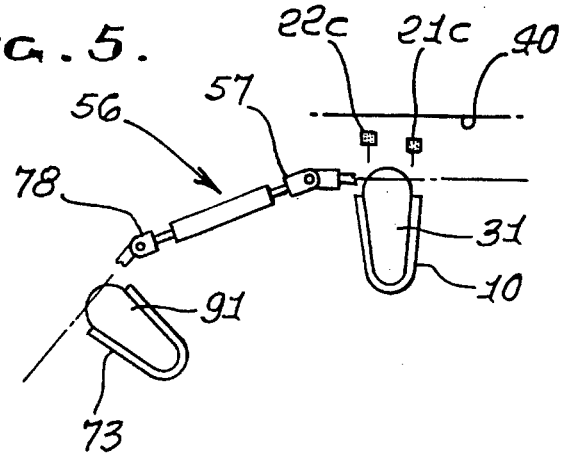

DRUM BEATER AND PEDAL APPARATUS ALLOWING INFINITELY ADJUSTABLE BEATER POSITIONING

BACKGROUND OF THE INVENTION

This application is a continuation-in-part of Ser. No. 08/190,499 filed Feb. 2, 1994, now U.S. Pat. No. 5,396,826; which is a continuation-in-part of Ser. No. 08/035,065 filed Mar. 22, 1993, now U.S. Pat. No. 5,361,670; which is a continuation of Ser. No. 07/783,864 filed Oct. 28, 1991, now U.S. Pat. No. 5,204,485 issued Apr. 20, 1993.

This invention relates generally to drum beating apparatus having multiple beaters, and more particularly concerns the operation and mounting of such beaters.

There is need for mechanism allowing infinitely adjustable at-rest positioning of a drum beater relative to a drum surface.

There is also need for drum beating apparatus in which two beaters are located close to one another to strike the same drum surface, but wherein the two beaters are independently adjustable relative to a drum surface or surfaces, and operable by foot pedals located at different, separate positions. No prior apparatus meets this objective in the novel and unusually advantageous ways as now afforded by the present invention incorporating unusually advantageous structural combinations and modes of operation.

SUMMARY OF THE INVENTION

It is a major object of the invention to provided improved drum beating apparatus meeting the above as well as other needs and objectives. Basically, the invention is embodied in a combination that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) a crank connected with the axle to rotate therewith, f) a return spring positioned to exert tension on the crank to yieldably resist axle rotation by the pedal, about the axis, g) an continuously variable connection between the spring and crank to allow adjustment of the position of spring tension exertion on the crank, about the axle axis, whereby the rest position of the beater relative to a drum surface may be continuously varied.

As will be seen, the continuously variable connection may include tongue and groove elements that have continuously variable interconnection the groove element is typically associated with the crank; and the tongue element is typically associated with the tension spring.

It is another object to provide the groove element in the form of a slot in the crank extending lengthwise arcuately partway about the axle axis in eccentric relation thereto, and the tongue element extends in the slot at an adjusted position lengthwise of the slot. The tongue may be a fastener releasably attached to the crank, as by clamping via a nut on the fastener shank. The spring may, in turn, be attached to the fastener via a bearing defining an axis of rotation coincident with the fastener axis. Such a bearing contributes to the virtually friction-free operation of the beater mechanism, which is driven by a bearing-supported pedal or pedals.

Yet another object is to provide:

a) a first frame including first pedestal means, b) first, second and third bearings carried by the first pedestal means, in spaced coaxial relation, c) a primary axle carried by the first and third bearings, and a primary drum beater carried by the primary axle, d) a secondary axle carried by the second and third bearings, and a secondary drum beater carried by the secondary axle, e) the primary and secondary axles being independently rotatable, there being a first pedal operatively connected to the primary axle to rotate the primary axle and primary drum beater in response to pedal pivoting, f) and a first base plate integrally supporting the first pedestal means, the first plate also supporting the first pedal for pivoting relative thereto, g) there being auxiliary means operatively connected to the secondary axle to rotate the secondary axle and secondary drum beater, the auxiliary means including a tertiary axle and a single pedestal which is the only pedestal supporting the tertiary axle for rotation, and a second pedal operable to rotate the tertiary axle, h) means supporting the single pedestal and the second pedal, i) and a tension spring connected to the primary axle via elements having continuously variable interconnection, about an axis defined by the primary axle.

Use of such a single pedestal (i.e., elimination of a second pedestal) provides more room for other percussion equipment, and saves overall weight.

As will appear, a bearing structure is typically carried by the single pedestal and supporting the tertiary axle for rotation; and a single rotor may be carried by the tertiary axle, with a flexible coupling interconnecting the other rotor and the second pedal.

Additionally, the third bearing structure typically may include two axially spaced bearing elements, there being a housing for those elements, and an arm carried by the first pedestal means and supporting the housing, the primary axle supported by one of the elements, and the secondary axle supported by the other of the elements.

Another object is to provide a primary rotor on the primary axle and a flexible coupling interconnecting the first pedal and primary rotor to rotate the rotor and primary axle when the pedal is pivotally displaced downwardly, and tension spring connected to the secondary axle via other elements having continuously variable interconnections, about an axis defined by the secondary axle.

A further object is to provide an elongated rotary link coupled to the secondary axle, the link consisting of relatively lightweight metal, the link defined by the auxiliary means. In this regard, and as regards such auxiliary means, the invention may provide a second frame including second and single pedestal means, and a second base plate, independent of the first frame; other bearing means on the second pedestal means; a tertiary axle carried by the other bearing means; the link operatively connecting the secondary and tertiary axles; there being a second pedal operatively connected to the tertiary axle to rotate the third axle, the link, the secondary axle, and the secondary drum beater; the second pedal and tertiary axle also defined by the auxiliary means; and a second base plate integrally supporting the second and single pedestal means, the second base plate also supporting the second pedal for pivoting relative thereto.

Yet another object is to provide a double drum pedal apparatus in which a first pedal frame is provided with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a supporting shaft supported by the first and second bearing portions, the shaft supporting the second beater being supported by the second and third bearing portions, whereby the second shaft is rotatable independently of the first shaft. Roller bearings are typically provided on the pedal frames to support the pedals for rotation.

Tension spring means is typically connected to at least one of the shafts via elements having continuously variable interconnection about an axis defined by the at least one shaft.

These and other objects and advantages of the invention, as well as the details of an illustrative embodiment, will be more fully understood from the following specification and drawings, in which:

DRAWING DESCRIPTION

FIG. 3 is a section taken on lines 3—3 of FIG. 2;

FIG. 5 is a diagrammatic view showing relative adjustability of two pedals on two base plates, in association with two drum beaters which have fixed relative positions;

DETAILED DESCRIPTION

Figure 1:
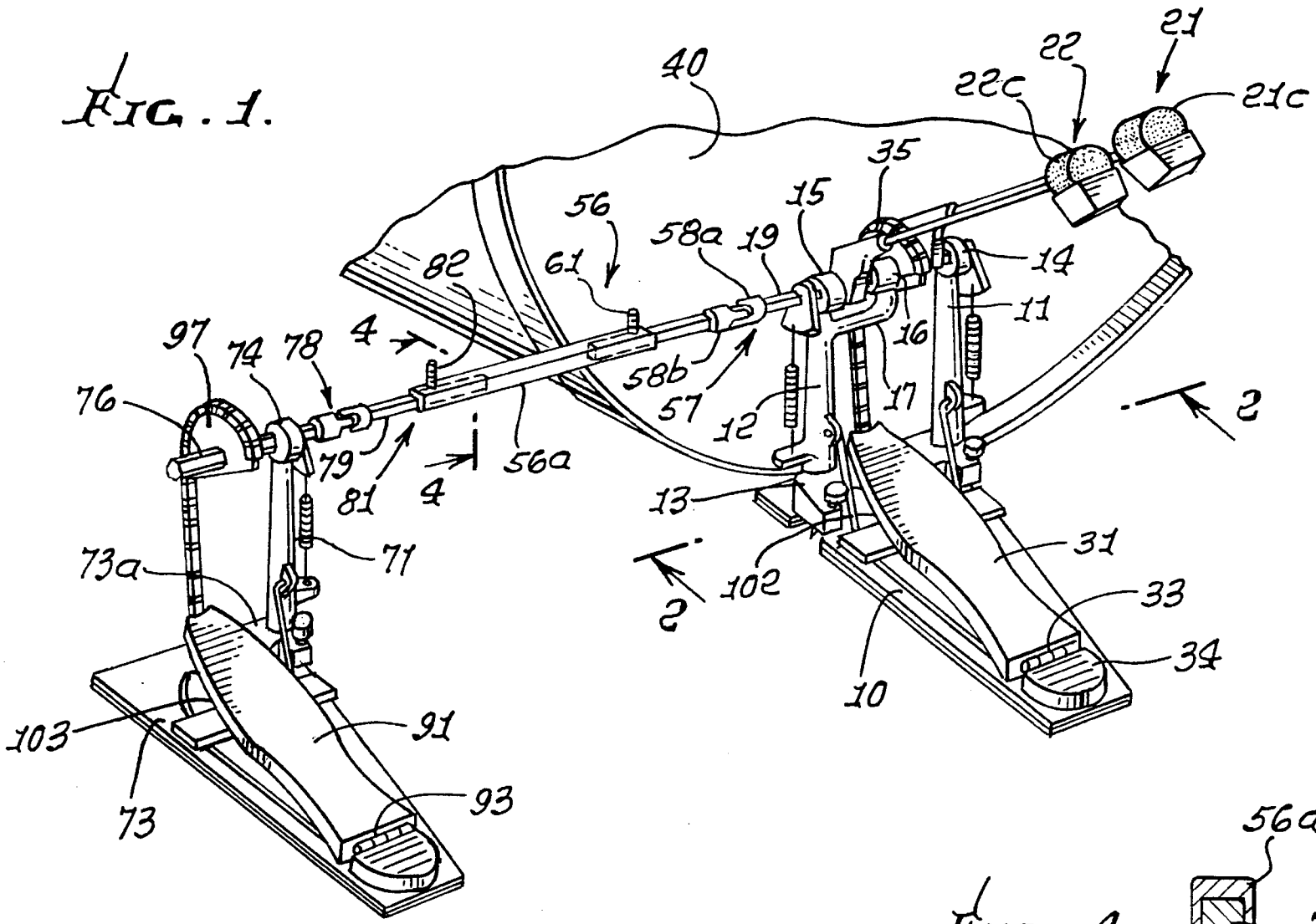
FIG. 1 is a perspective view of the apparatus incorporating the invention.
Figure 4:
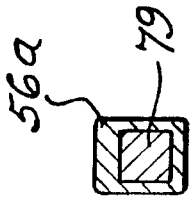
FIG. 4 is a section taken on lines 4—4 of FIG. 1.

In the drawings, a first horizontal, longitudinally extending base plate 10 integrally supports a first frame that includes first pedestal means. Such pedestal means is shown to include laterally spaced, upright pedestals 11 and 12, the lower ends of which are carried by a bottom yoke 13 attached to a base plate forward portion. The upper ends of the pedestals carry first and second coaxial bearing sleeves 14 and 15, which are laterally spaced apart. The pedestal means also carries third bearing structure 16, and specifically, an arm 17 extends laterally rightwardly from pedestal 12, and upwardly, to support structure 16. The latter includes a bearing housing 16*a*, and two roller bearing parts 16*b* and 16*c* positioned in housing 16*a*, in laterally spaced relation. Arm 17 is elbow-shaped and is integral with 12 and 16*a*. A primary axle or shaft 18 is carried by the first and third bearings, and specifically, by bearing sleeve 14 and bearing part 16*b*; and a secondary axle or shaft 19 is carried by the second and third bearings, and specifically, by the bearing sleeve 15 and bearing part 16*c*, the axles 18 and 19 being independently rotatable, yet coaxial.

A primary drum beater 21 is carried by the primary axle 18, and a secondary drum beater 22 is carried by the secondary axle 19, whereby the two beaters are separately operable. Note that the beater 21 has a shaft 21*a* and a connector 21*b* to axle 18; and beater 22 has a shaft 22*a* and a connector 22*b* to axle 19, both connectors laterally spaced, and located between the bearing sleeves 14 and 15 on the pedestals. See also the beater heads 21*c* and 22*c*. Axles 18 and 19 are polygonal to rigidly connect to the elements 21*b* and 22*b*.

A first pedal 31 is operatively connected to the primary axle 18 to rotate that axle and the primary beater 21 in response to pedal pivoting effected by the foot of the drummer.

In the FIG. 3 example, the pedal is pivoted at 33 to a heel support 34 attached to plate 10. Pivot 33 typically comprises roller bearing means, such as ball bearings, to reduce friction. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the beater 21 rotates forwardly, so that head 21*c* strikes the drum surface indicated at 40. Yieldable means, such as tension spring 41 is operatively connected between the primary axle and the frame, such as the lower end of pedestal 11, to yieldably resist axle rotation, and return the beater to FIG. 3 position. Note that spring 41 has its upper end connected to crank 42 on shaft or axle 18.

A similar spring 46 is operatively connected between secondary axle 19 and the frame, such as the lower end of pedestal 12, to yieldably resist axle 19 rotation, to return secondary drum beater 22 to retracted position, as indicated in FIG. 3. That spring has its upper end connected to a crank 49 on shaft 19.

Axles 18 and 19 may have square cross sections to enable positive connection of the sleeve-type connectors 21*c* and 22*c* to the axles, set screws 21*d* and 22*d* also being provided. Annular bearings receive the axles for reception in the bearing sleeves 14 and 15.

The surface portions, including teeth 53 on the sprocket 37, may be located at progressively increasing radii from an axis 54 defined by axle 18, and located angularly about that axis, whereby those surface portions extend eccentrically relative to axis 54, as disclosed in U.S. Pat. No. 4,756,224. This causes the beater to travel progressively faster toward the drum surface, as the pedal is displaced downwardly at a fixed angular velocity.

The secondary axle 19 and secondary drum beater 22 may be rotatable by auxiliary means not mounted on plate 10. Such secondary means may, for example, include an elongated and elongatable rotary link 56 coupled to axle 19, as by coupling structure 57. The latter is shown to include universal joint members 58*a* and 58*b* rotatably interconnected by cross pin 58*c*. Member 58*a* is connected to the end 19*c* of axle 19 projecting away from the bearing 15; and member 58*b* is connected to a square cross section sub-shaft 59, as by transverse pin 60. Shaft 59 is also received in and connected to link member 56*a* via a coupling set screw 61, allowing extension of 56*a* and 59.

Figure 2:
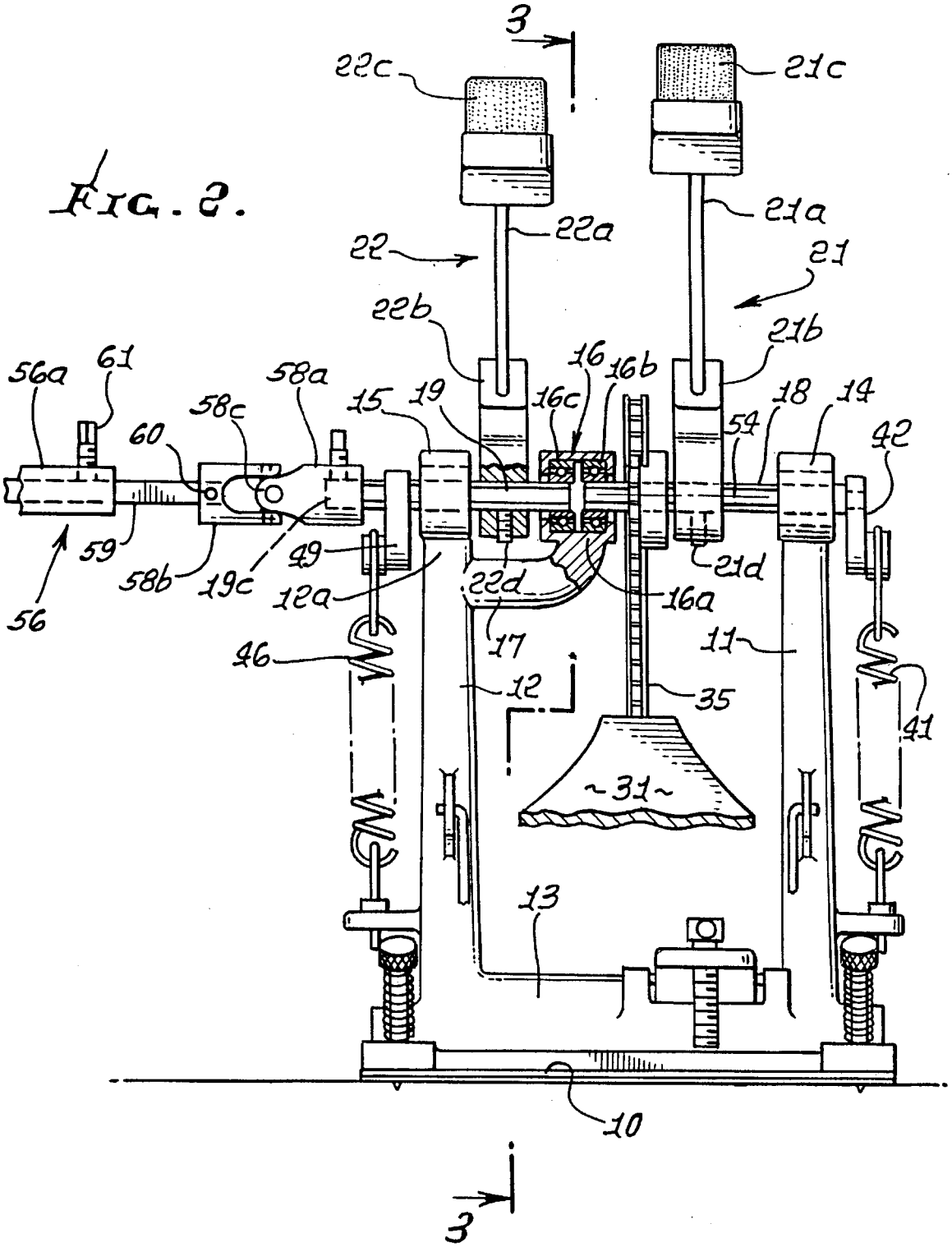
FIG. 2 is an enlarged section taken in elevation on lines 2—2 of FIG. 1.

Note that bearing 15 is coaxial with bearing 16, and carried by upper extension 12*a* of the pedestal. That upper extension 12*a* and arm 17 form a yoke, and between which beater 22 connector 22*b* is located. The two bearings 16*b* and 16*c* being separate may allow for some degree of axial mis-alignment of the axles 18 and 19, whereby each axle 18 and 19 is freely supported for rotation by only two bearings, yet the two beaters are located in close lateral relation, as seen in FIG. 2. Arm 17 is located above the pedal 31 so as not to interfere with it.

Figure 6:
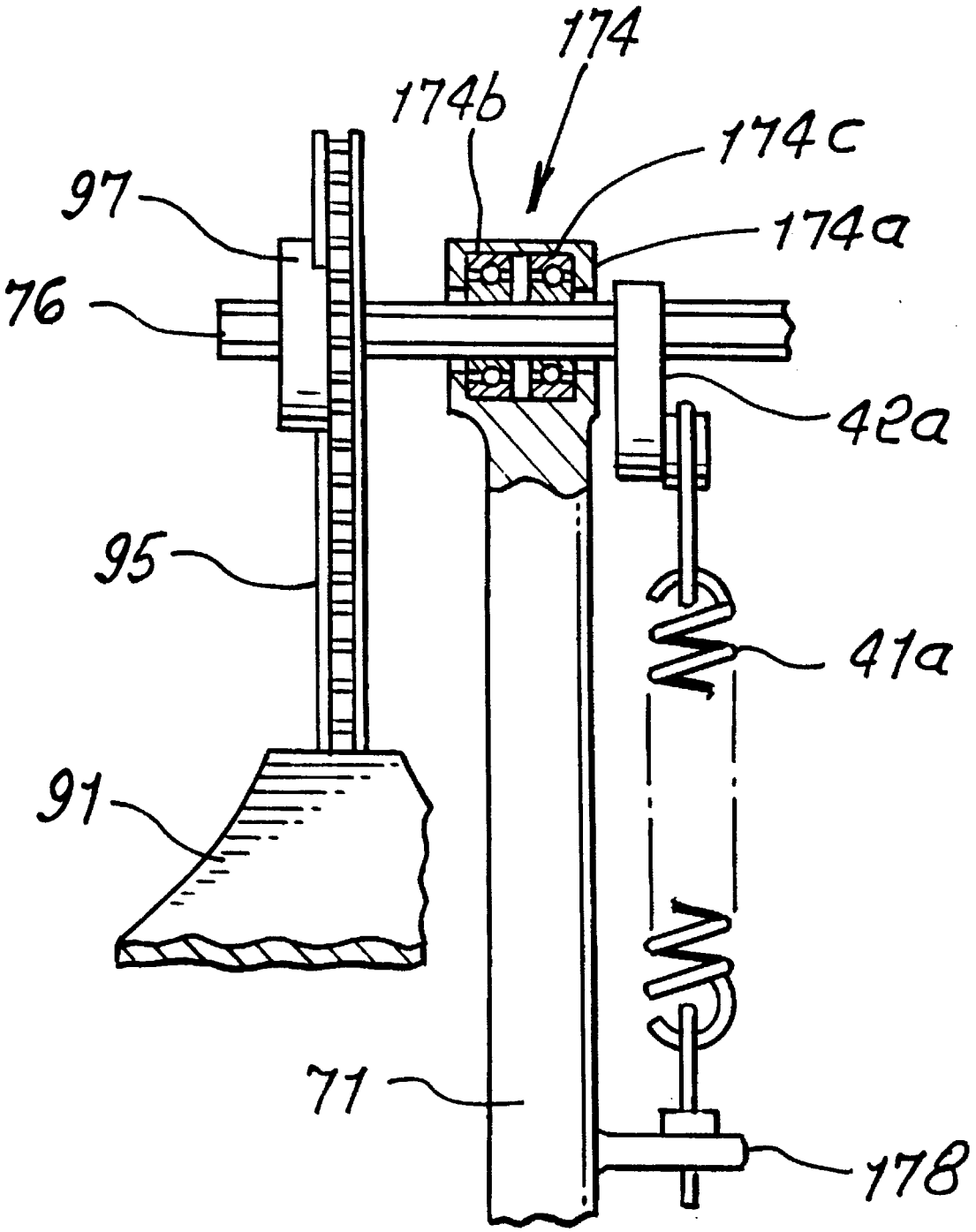
FIG. 6 is a fragmentary frontal view of the auxiliary pedal and single pedestal carrying the tertiary shaft.

FIGS. 1 and 6 show the provision of a second frame, including second pedestal means, such as single, upright pedestal 71. The latter is integrally mounted via bottom support 73*a* on a second base plate 73 which is independent of plate 10 and can be adjustably positioned at different locations relative to plate 10, to suit the drummer. See FIG. 5. Other bearing structure is carried by the second pedestal 71, and a tertiary axle or shaft 76 extends laterally and is shown as carried for rotation by the bearing 174. Link 56 is connected to tertiary axle 76 as by structure corresponding to structure 57. See for example universal joint 78, square cross section sub-shaft 79, and elongatable coupling 81. Set screws 82 and 61 are associated with the couplings 61 and 56 to adjustably grip the sub-shafts, allow complete disassembly or disconnection of the two axles 19 and 76, and the two base plates 10 and 73. Elongated link member 56*a* advantageously consists of lightweight metal, such as aluminum.

A pedal 91 is pivotally mounted at 93 on second base plate 73, and a flexible coupling, such as a chain 95, couples the forward end of the pedal 91 to a sprocket 97 attached to axle 76. Accordingly, the pedal 91 is coupled to the second beater 22 to rotate same, as pedal 91 is pushed downwardly. Plate or sprocket 97 may be eccentric, as described above, as respects sprocket 37. Holder members 102 and 103 also support the pedestals on the base plates, as shown.

As shown in FIG. 6, the bearing 174 includes a housing 174*a* and two roller bearing parts 174*b* and 174*c* positioned in housing 174*a*, in laterally spaced-apart relation. Single pedestal 71 supports bearing 174. A tension spring 41*a* and crank 42*a* are connected between the shaft 76 and lug 178 on the pedestal, to yieldably and resiliently return the shaft 76 and pedal 91, and beater 22, to initial rotary positions.

Accordingly, the invention in one of its aspects provides a first pedal frame with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a first supporting shaft supported by the first and second bearing portions, the second shaft supporting the second beater being supported by the second and third bearing portions, whereby the second shaft is rotatable independently of the first shaft. There is also an additional shaft coupled to one of the first and second shafts, and a single pedestal on the second pedal frame and being the only pedestal supporting the additional shaft, saving weight and providing added space or room for other percussion equipment close to the drummer. A very simple adjustable pedal structure is thereby provided.

Adjustable clamp means 110 on the forward end of the plate 10 clamps to drum structure 40*a*, as shown.

Figure 7:
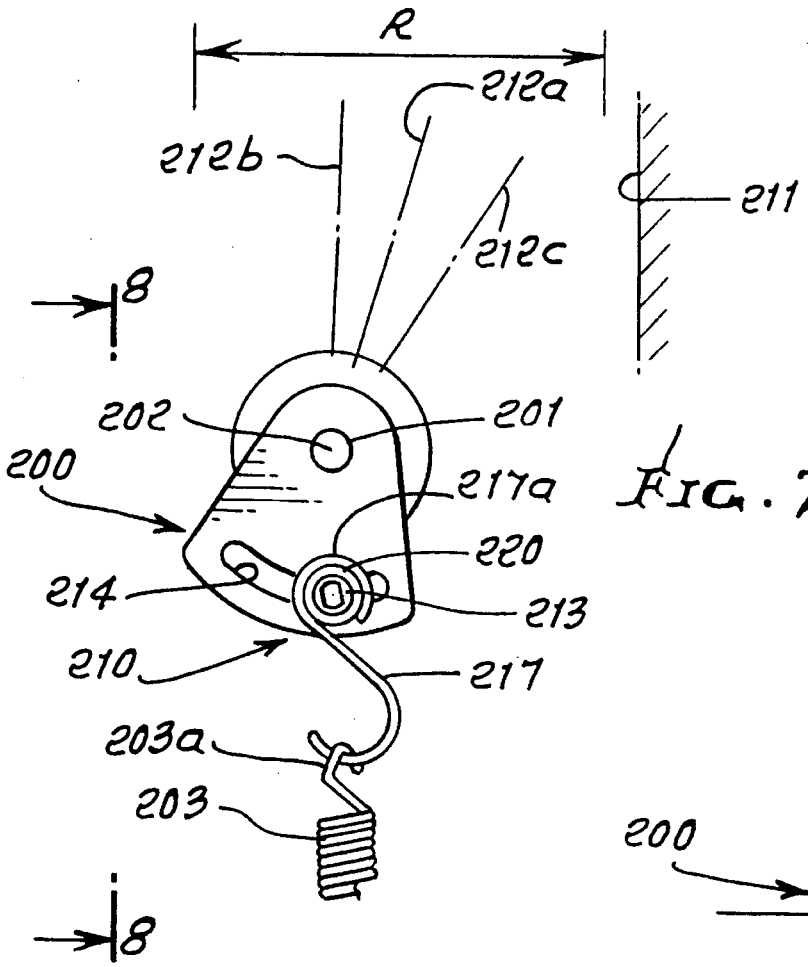
FIG. 7 is an enlarged side elevation showing an infinitely adjustable connection.
Figure 8:
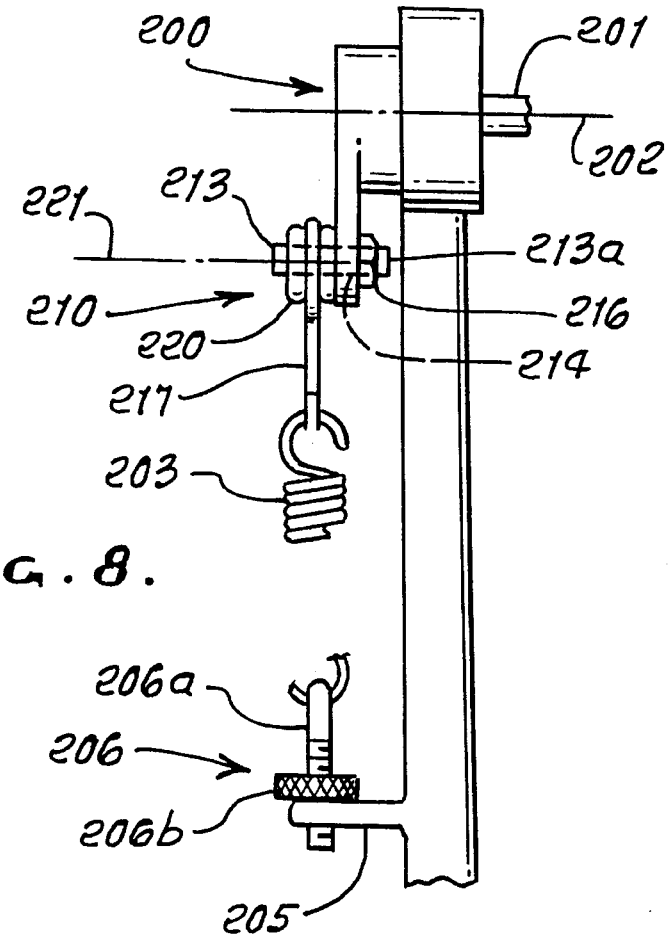
FIG. 8 is an elevation taken on lines 8—8 of FIG. 7.

Referring now to FIGS. 7 and 8, one or more of the cranks 42, 49 and 42*a* may have the form shown at 200, the axle to which the crank is connected indicated at 201, and the axes of axle and crank rotation being shown at 202. The return (tension) spring acting on the crank is shown at 203, and may represent any of the springs 41, 46, and 41*a*. One end of the spring is adjustably anchored to the pedal frame, indicated at 205. See threaded vertical axial adjustment 206 provided by a threaded shank 206*a* and an adjustable clamping nut 206*b*, whereby spring tension may be adjusted.

An infinitely adjustable variable connection is provided between the crank and the tension spring, as generally indicated at 210. Its purpose is to allow accurate, for example infinitely adjustable, at-rest positioning of the drum beater carried by the shaft 201, and relative to a drum surface indicated at 211. See for example the different at-rest positions of the beater at 212*a*, 212*b*, 212*c*, etc. in FIG. 7, and to which the beater may be adjusted. An infinite number of such beater positions may be selected within a selected range indicated, for example, by the dimension R.

The illustrative connection 210, which is preferred but of which there may be variations, include a tongue in the form of a fastener 213 having a shank 213*a* passing into or through a groove or slot 214 in the crank. Slot 214 is endwise elongated in an arcuate direction about axis 202, and so that fastener shank 213*a* may be shifted to any one of an infinite number of positions along the slot length. A nut 216 on a threaded portion of the shank 213*a* may be tightened to clamp, i.e., connect the fastener in selected position (about axis 202) to the crank. This fixes the point of spring force transmission to the crank, since the spring is attached to the fastener, as shown, via a hook 217 hook-shaped attached to spring end 203*a*, and the at-rest angularity of the crank and the beater are thereby selected. Loosening of the nut allows adjusted connection of the spring to the crank, as referred to.

A bearing, as for example a ball bearing unit 220, is carried by the fastener, to have its axis 221 in coincidence with the fastener shank axis, i.e., parallel to axis 202. The hook end 217*a* fits over the bearing, as shown.

I claim:

1. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) a crank connected with the axle to rotate therewith, f) a return spring positioned to exert tension on the crank to yieldably resist axle rotation by the pedal, about said axis, g) and a continuously variable connection between said spring and crank to allow adjustment of the position of spring tension exertion on the crank, about said axle axis, whereby the rest position of the beater relative to a drum surface may be infinitely adjusted.

2. The combination of claim 1 wherein said connection includes tongue and groove elements that have continuously variable interconnection.

3. The combination of claim 2 wherein said groove element is associated with the crank, and said tongue element is associated with the tension spring.

4. The combination of claim 3 wherein said groove element is a slot in the crank extending lengthwise arcuately partway about said axle axis in eccentric relation thereto, and said tongue element extends in said slot at an adjusted position lengthwise of the slot.

5. The combination of claim 4 wherein said tongue is a fastener releasably attached to the crank.

6. The combination of claim 5 wherein the fastener defines an axis parallel to the axle axis, and the spring is connected to the fastener via a bearing defining an axis of rotation coincident with the fastener axis.

7. The combination of claim 5 wherein the fastener includes a stem projecting through the slot, the stem having a threaded portion, and a nut on said threaded portion exerting clamping force on the crank.

8. In a drum beating assembly, the combination comprising a) a first frame including first pedestal means, b) first, second and third bearings carried by the first pedestal means, in spaced coaxial relation, c) a primary axle carried by the first and third bearings, and a primary drum beater carried by the said primary axle, d) a secondary axle carried by the second and third bearings, and a secondary drum beater carried by said secondary axle, e) said primary and secondary axles being independently rotatable, there being a first pedal operatively connected to the primary axle to rotate the primary axle and primary drum beater in response to pedal pivoting, f) and a first base plate integrally supporting said first pedestal means, the first plate also supporting the first pedal for pivoting relative thereto, g) there being auxiliary means operatively connected to the secondary axle to rotate the secondary axle and secondary drum beater, said auxiliary means including a tertiary axle and a single pedestal which is the only pedestal supporting the tertiary axle for rotation, and a second pedal operable to rotate the tertiary axle, h) means supporting the single pedestal and said second pedal, i) and a tension spring and a continuously variable connection between said spring and said primary axle.

9. The combination of claim 8 including a primary rotor on the primary axle and a flexible coupling interconnecting the first pedal and primary rotor to rotate the rotor and primary axle when the pedal is pivotally displaced downwardly, and another tension spring and another continuously variable connection between said other spring and said secondary axle.

10. The combination of claim 8 wherein said third bearing includes two axially spaced bearing elements, a housing for said elements, and an arm carried by the first pedestal means and supporting the housing, the primary axle supported by one of said elements, and the secondary axle supported by the other of said elements.

11. The combination of claim 8 wherein the primary rotor has surface portions engaged by said coupling means, said surface portions located at progressively increasing radii from an axis defined by said primary axle, and angularly about said axis.

12. The combination of claim 10 wherein said surface portions extend eccentrically relative to said axis.

13. The combination of claim 8 including an elongated rotary link coupled to said secondary axle, and to said tertiary axle, said link consisting of relatively lightweight metal.

14. The combination of claim 8 including a bearing structure carried by the single pedestal and supporting said tertiary axle for rotation.

15. The combination of claim 14 wherein said bearing structure includes two axially spaced bearing elements, a housing for said elements, said single pedestal supporting the housing.

16. The combination of claim 15 including return spring means and a crank associated with said single pedestal and coupled to said tertiary axle, said return spring means and crank located at the side of said single pedestal closest to said first frame, there being an infinitely adjustable connection between said return spring means and said crank associated with said single pedestal.

17. The combination of claim 8 including a primary rotor on the primary axle and a flexible coupling interconnecting the first pedal and primary rotor to rotate the primary rotor and primary axle when the first pedal is pivotally displaced downwardly; there being another rotor on the tertiary axle, and a flexible coupling interconnecting the other rotor and said second pedal.

18. The combination of claim 17 wherein said rotors have coupling engageable surfaces which are each eccentric relative to said primary and tertiary axles, respectively.

19. A double drum pedal apparatus in which a first pedal frame is provided with rotatable first and second beaters, and a first pedal for rotating said first beater when pushed down; a second pedal frame being provided with a second pedal; said second beater having a second supporting shaft operatively connected to said second pedal; and characterized in that said first pedal frame is provided with first, second and third bearing portions, the first beater having a first supporting shaft supported by said first and second bearing portions, said second shaft supporting the second beater being supported by said second and third bearing portions, whereby the second shaft is rotatable independently of the first shaft, there being an additional shaft coupled to one of said first and second shafts, and a single pedestal on the second pedal frame and supporting the entire additional shaft, tension spring means and a continuously variable connection between said tension spring means and at least one of said shafts.

20. The combination of claim 13 wherein said metal consists of aluminum.

21. The combination of claim 8 including roller bearing means carried by the first plate to support the first pedal for rotation.

22. The combination of claim 8 including a second frame, and roller bearing means carried by the second plate to support the second pedal for rotation.

23. In a drum beater assembly, the combination comprising a) first and second bases which are spaced apart, b) first shaft means and first pedestal means on the first base supporting the first shaft means for rotation, c) first and second beater means carried by the first means, d) second shaft means and a single pedestal on the second base carrying the second shaft means for rotation, the second shaft means operatively connected to the first shaft means, e) pedals on the bases and operatively connected to the first and second shaft means, f) tension spring means and a continuously variable operative connection between said spring means and at least one of said first and second shaft means to allow arcuate at-rest positioning of the beater means on said shaft means relative to a drum surface.

24. The combination of claim 23 wherein the first shaft means includes a primary shaft carrying the first beater means and a secondary shaft carrying the second beater means, and rotatable independently of the primary shaft, the second shaft means operatively connected to only the primary shaft.

25. The combination of claim 24 including bearing structure carried by the single pedestal and supporting the second shaft means for rotation, said bearing structure includes two axially spaced bearing elements, a housing for said elements, said single pedestal mounting the housing.

26. The combination of claim 23 including roller bearings on the bases and supporting the pedals for rotation.

* * * * *